United States Patent [19]

Nicholson et al.

[11] 4,378,031

[45] Mar. 29, 1983

[54] ELECTROHYDRAULIC SERVOVALVE

[75] Inventors: Robert D. Nicholson, Birmingham; Harish S. Patel, Madison Heights; Alger T. Daniel, Clawson, all of Mich.

[73] Assignee: Koehring Company, Brookfield, Wis.

[21] Appl. No.: 41,493

[22] Filed: May 22, 1979

[51] Int. Cl.[3] ..... F15B 13/043

[52] U.S. Cl. ..... 137/625.63; 137/83; 137/625.64

[58] Field of Search ..... 137/83, 625.63, 625.64

[56] References Cited

U.S. PATENT DOCUMENTS

| | | | |
|---|---|---|---|
| 2,964,018 | 12/1960 | Farron | 137/625.61 |
| 3,024,810 | 3/1962 | Barlow | 137/82 |
| 3,081,787 | 3/1963 | Meulendyk | 137/83 |
| 3,217,728 | 11/1965 | Pegram | 137/625.64 X |
| 4,227,443 | 10/1980 | Toot | 137/625.61 X |
| 4,282,502 | 8/1981 | Nicholson | 335/229 X |

FOREIGN PATENT DOCUMENTS

| | | | |
|---|---|---|---|
| 630460 | 9/1978 | U.S.S.R. | 137/83 |

*Primary Examiner*—Gerald A. Michalsky

*Attorney, Agent, or Firm*—Barnes, Kisselle, Raisch, Choate, Whittemore & Hulbert

[57] ABSTRACT

A two-stage miniature electrohydraulic servovalve including an electromagnetic positioner having a flexure tube mounted drive arm secured to and movable with an armature movable in accordance with a combined magnetic field resulting from both permanent magnets and an electrical signal fed to electromagnetic coils, a four-way hydraulic valve main valve stage including a valve body having a sleeve mounted therein with two annular, internal, axially spaced apart metering grooves, a metering spool having five lands alternating with four metering grooves positioned within the sleeve for controlled axial movement with respect to the sleeve, and end caps positioned over the ends of the sleeve and a jet pipe pilot stage including a jet pipe member secured to the end of the drive arm having a jet pipe nozzle aligned with the drive arm and a hydraulic fluid feeder passage which passage is disposed at right angles to the plane of movement of the drive arm, a resiliently mounted counterbalance positioned on the drive arm, and passages in the spool from adjacent the jet pipe nozzle to the opposite ends of the spool.

13 Claims, 4 Drawing Figures

ELECTROHYDRAULIC SERVOVALVE

BACKGROUND OF THE INVENTION

1. Field of the Invention

The invention relates to servovalves and refers more specifically to a two-stage miniature servovalve having an electromagnetic positioner, a jet pipe pilot stage, and a four-way hydraulic valve, main valve stage incorporating position follower spool control, which miniature servovalve exceeds ARP 490Csize IB requirements and allows passage of up to one hundred fifty micron particles without malfunction.

2. Description of the Prior Art

Prior servovalves have had difficulty in meeting performance, simplicity, stability, ruggedness and reliability requirements of aerospace related industries in a valve sufficiently small and light enough to be practical in many aerospace applications.

Prior servovalves have often included positioners which were mechanically, hydraulically or electrically actuated. Such valves have also often included spool or flapper type pilot stages. In addition, wherein the second stage or hydraulic valve portion of prior servovalves have been four-way hydraulic valves, they have often included metering spools having only three lands thereon whereby the critical dimensions of the valve spool are effectively elongated by varying hydraulic valve pressures.

SUMMARY OF THE INVENTION

The servovalve of the present invention is a two-stage miniature servovalve including an electromagnetic positioner, a jet pipe pilot stage, and a four-way hydraulic main valve stage incorporating position follower type spool control.

The electromagnetic positioner of the invention combines the magnetic field of permanent magnets with a magnetic field produced by a variable electric signal or signals to position a drive arm mounted on a flexure tube in accordance with the strength and the polarity of the electrical signal or signals.

The jet pipe pilot stage of the servovalve of the invention includes a jet pipe member secured to the end of the drive arm of the positioner receiving pilot stage hydraulic fluid for discharge through a jet pipe nozzle axially of the drive arm from a larger second nozzle at right angles to the plane of movement of the drive arm. The pilot stage of the servovalve further includes a resiliently mounted counterbalance on the drive arm of the positioner and radially and then axially extending passages in the spool of the second stage of the servovalve from the center thereof to each spool end.

The second stage of the two-stage servovalve includes a valve body, a sleeve mounted in the valve body having two internal axially spaced apart metering grooves therein, a spool positioned within the sleeve having five separate lands thereon with four metering grooves therebetween, and end caps positioned over each end of the sleeve.

The electrohydraulic servovalve of the invention so constructed may be small in size, lightweight and is particularly simple in design, stable in performance, rugged and reliable.

DESCRIPTION OF THE PREFERRED EMBODIMENT

The two-stage miniature electrohydraulic servovalve 10 of the invention includes an electromagnetic positioner 12, a first or pilot stage 14, and a second or main valve stage 16.

Figure 4:
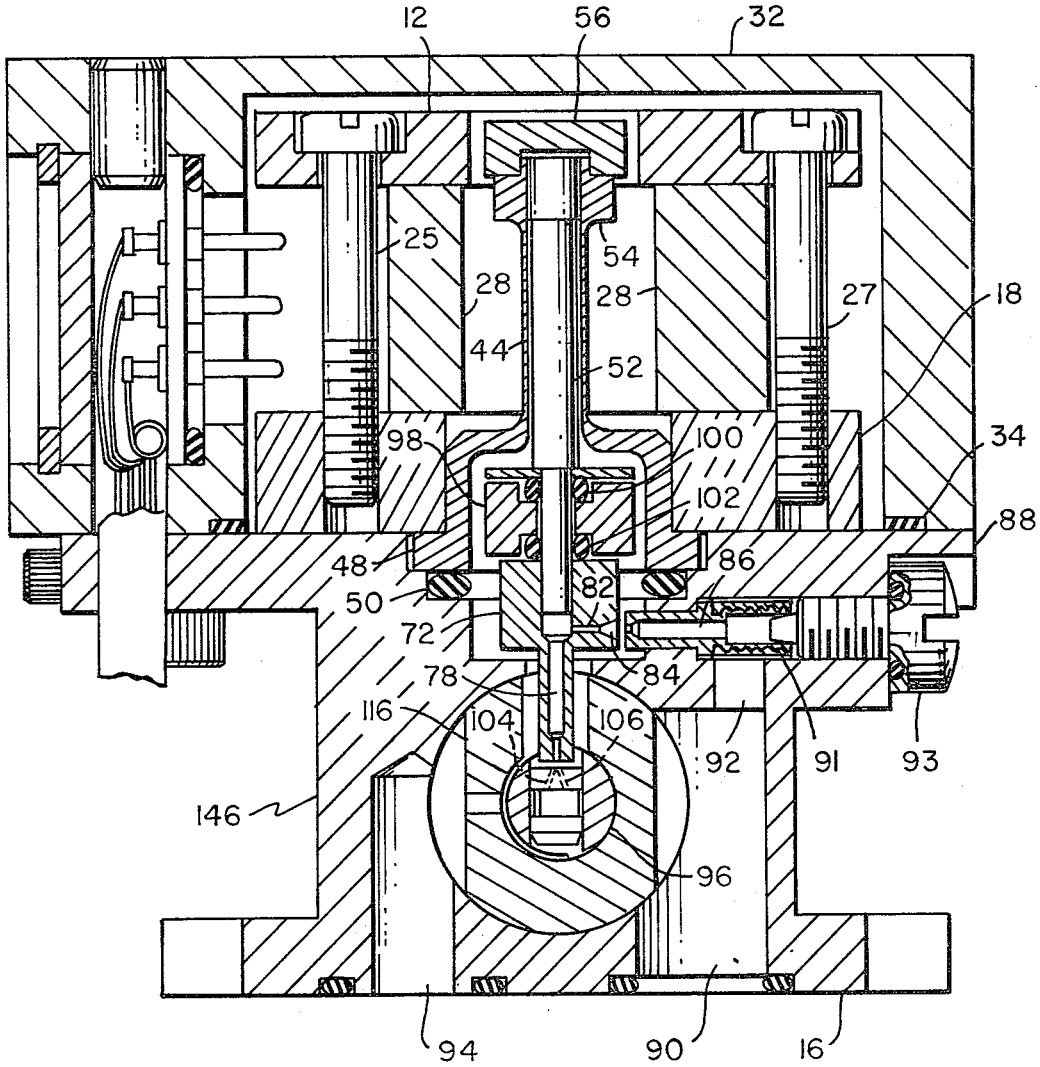
FIG. 4 is a section view of the servovalve of FIG. 1, taken substantially on the line 4—4 in FIG. 1.

The electromagnetic positioner 12 includes a mounting plate 18, poles 20 and 22 secured to the mounting plate 18 by convenient means, not shown, a top plate 24 having an opening 26 therein, and magnets 28 extending between the mounting plate 18 and the top plate 24 on each side of the mounting plate 18 parallel to each other. The top plate, magnets and mounting plate are secured together by convenient means such as bolts 25 and 27, as shown in FIG. 4.

Figure 1:
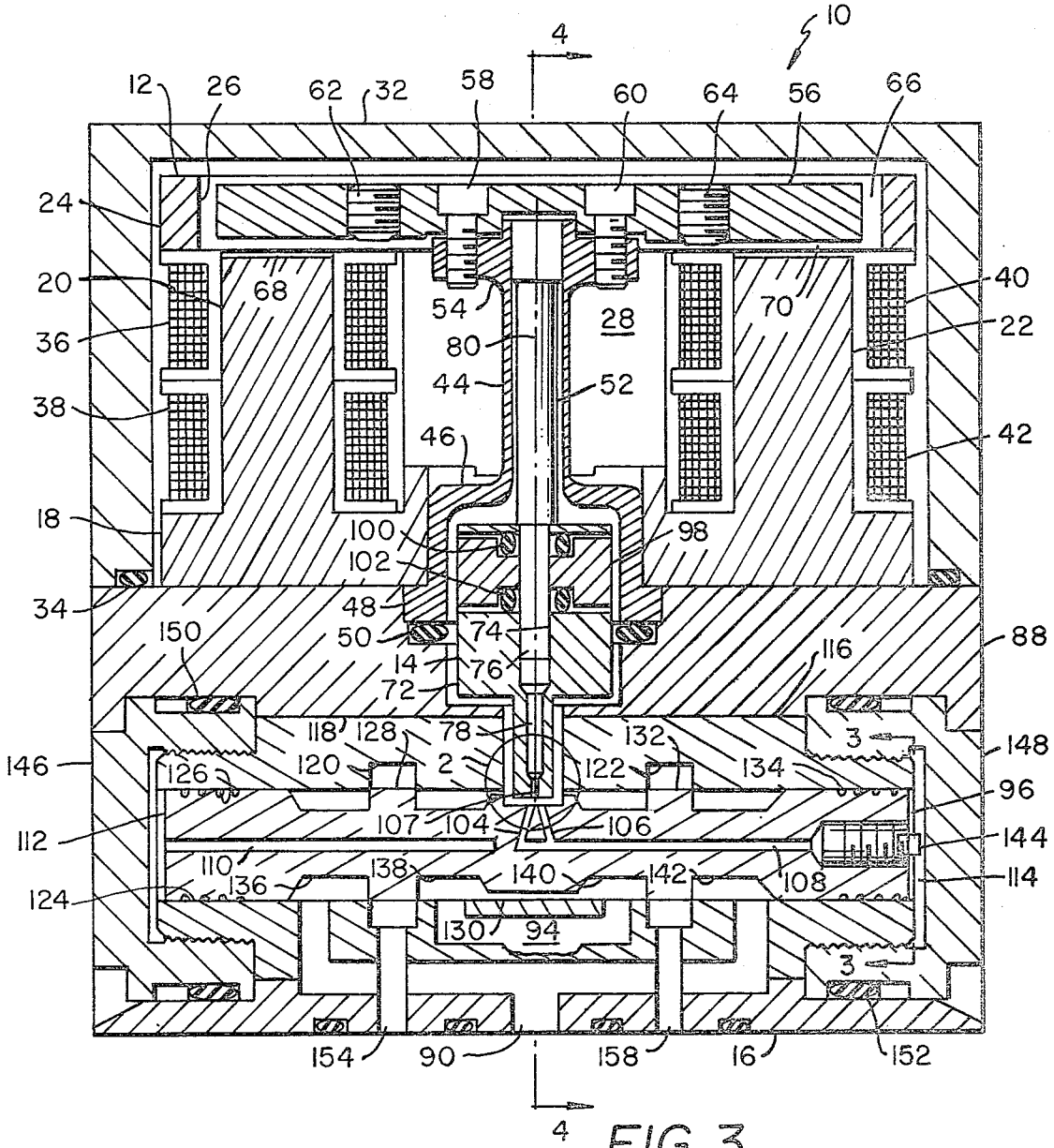
FIG. 1 is a longitudinal section view of a two-stage miniature electrohydraulic servovalve constructed in accordance with the invention.

The electromagnetic positioner 12 further includes four separate coils 36, 38, 40 and 42 sleeved over the poles 20 and 22 in pairs, as shown best in FIG. 1. As shown, one end of one of the coils 36, 38 is connected to one end of one of the coils 40, 42. The two connected coils are in series with each other and are wound about their respective poles 20, 22 in opposite directions. The other two coils are similarly connected and are wound about their respective poles in opposite directions. The other ends of each of the coils are presented so that the four coils appear as only two coils which have identical functions.

The two apparent coils may then be driven together in series or parallel, as desired. Thus, if opposing currents are applied to the two apparent coils simultaneously, the magnetic effects of both are cancelled. However, if one current is greater than the other, the effect would be the same as applying only the difference in current to the coil having the greater current therein. Control is thus effected by differential current input to the coils.

The electromagnetic positioner 12 further includes a flexure tube 44 having the radially enlarged end 46 with the flange 48 thereon which is secured in the electrohydraulic valve assembly 10 between the mounting plate 18 and the second stage valve structure 16. As shown best in FIG. 1, an O-ring seal 50 is provided between the flexure tube 44 and the second stage valve structure 16.

A drive arm 52 is supported from the end 54 of the flexure tube 44 and an armature 56 is secured to the end 54 of the flexure tube 44 by convenient means such as bolts 58 and 60. Limiting screws 62 and 64 are positioned in the armature 56, as shown best in FIG. 1, to limit the movement of the armature 56 in operation of the electromagnetic positioner 12.

In operation of the electromagnetic positioner 12, the input is electric current which may be placed into the coils 36, 38, 40 and 42, which current is magnetically converted into a position of the drive arm 52. Hence, the positioner 12 is termed an electromagnetic positioner.

The input-output relationship of the electric current and the drive arm is made linear and proportional through the permanent magnets 28 positioned on the opposite side of the flexure tube, which permanent magnets establish a permanent field that acts in combination with magneto-motive forces due to the current input to the coils 36, 38, 40 and 42.

Thus, for a positive current applied to the coils, the drive arm 52 will move in one direction, for example, to the right in FIG. 1, and for a negative current applied to the coils, the drive arm 52 will move in the opposite direction, or to the left in FIG. 1. Further, if half as much current is applied to the coils 36, 38, 40 and 42, the movement of the drive arm 52 is half as great.

In such movement of the drive arm 52, the flux generated by the magnets 28 passes from the top plate 24 to the armature 56 through the air gap 66 around the perimeter of the armature. The flux density in the air gap 66 is relatively low. The flux leaves the armature through two parallel paths which consist of the air gaps 68 and 70 between the ends of the armature 56 and the poles 20, 22. Since the poles 20, 22 are attached to the mounting plate 18, the magnetic circuit is completed back to the magnets 28. In both of the air gaps 68, 70 between the poles 20, 22 and the armature 56, the direction of the flux is the same, that is, from top to bottom.

When current is applied to the coils 36, 38, 40 and 42, a control flux is produced which is proportional to the applied current. This control flux will go up one of the poles 20, 22, through the associated air gap 68 or 70, into the armature 56, across the armature to the air gap over the other pole, down that pole and across the mounting plate 18 to the first pole, completing a control flux circuit. If the polarity of the current in the coils is reversed, the direction the control flux takes through this path is reversed.

Since the control flux goes up through one air gap and down through the other, it will be in the same direction as the permanent flux produced by the permanent magnets in one of the air gaps 68 and 70 and in the opposite direction in the other of the air gaps. The result is an increased pull on the armature 56 on the end thereof with the flux going in the same direction and a decreased pull on the armature on the end thereof where the control and permanent fluxes are going in opposite directions. The result is a net unbalanced force on the armature 56 which is proportional to the input current. This unbalanced force is converted to a proportional displacement of the armature 56 by the spring rate of the flexure tube 44.

The flexure tube 44 also serves to isolate the electromagnetic positioner from hydraulic fluid while motion is transmitted to the drive arm 52 through a frictionless pivot.

An aluminum cover 32 surrounds the electromagnetic positioner 12, as shown, and is secured to the main valve portion 16 of the electrohydraulic servovalve 10 by convenient means such as bolts, not shown. A sealing gasket 34 seals between the cover 32 and the second or main valve stage 16.

Figure 2:
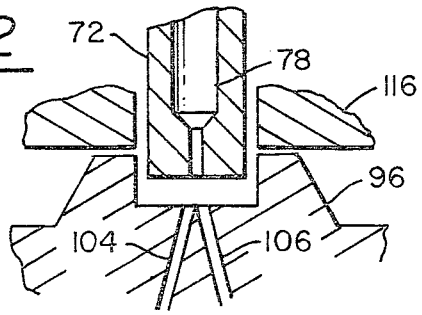
FIG. 2 is an enlarged view of the portion of the servovalve shown in the circle 2 in FIG. 1.
Figure 3:
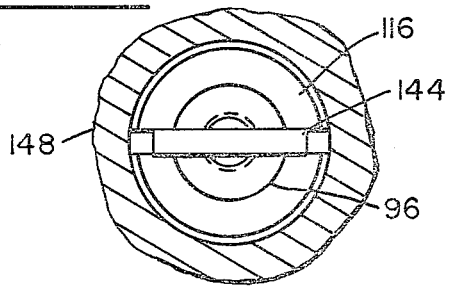
FIG. 3 is a partial section view of the servovalve of FIG. 1, taken substantially on the line 3—3 in FIG. 1.

The pilot or first stage 14 of the electrohydraulic servovalve 10 includes a jet pipe member 72 having an opening 74 therein in which the jet pipe member 72 is secured to the end 76 of the drive arm 52. A jet pipe nozzle 78 is provided in the jet pipe member 72 on the axis 80 of the drive arm 52, as shown best in FIG. 1. In addition, a feeder passage 82 having an enlarged end 84 is provided in the jet pipe member 72 as shown in FIG. 4. A second jet pipe nozzle 86, as shown best in FIG. 2, is provided in the body member 88 of the second or main valve stage 16 of the servovalve 10 and is connected to a hydraulic fluid pressure input line 90 through the main valve stage 16, through passage 92 in the valve body member 88. Filter screen 91 is removably held in position in passage 90 between nozzle 86 and input line 90 by removable plug 93 as shown in FIG. 4.

Further, it will be noted that the second nozzle 86 is in communication with the jet pipe member 72 at right angles to the direction of movement of the jet pipe nozzle 78 with the drive arm 52. Thus, the flow forces of the hydraulic fluid through the jet pipe member 72 will not influence the electromagnetic positioner position, and therefore will not influence the hydraulic fluid from the jet pipe nozzle 78 as it passes into the receiver passages 104 and 106 in the spool valve 96 of the main valve stage 16.

In operation, hydraulic fluid under pressure, of for example, 3000 p.s.i., from input line 90 through filter screen 91, in passage 92 will pass out of the nozzle 86 and into the feeder passage 82 in the jet pipe member 72 and is subsequently passed out from the jet pipe nozzle 78 at a reduced pressure of, for example, 1000 p.s.i. Filter screen 91 prevents the nozzles from becoming plugged up. Since the hydraulic pressure within the flexure tube 44 and that surrounding the jet pipe member 72 and nozzle 78 is effectively return fluid pressure in the return hydraulic fluid line 94, the pressure from the jet pilot nozzle 78 is reduced to approximately 1000 p.s.i.

The fluid connection between the hydraulic fluid input line 90 and the jet pipe nozzle in the pilot stage of valve 10 is thus accomplished without any mechanical connections and is simpler and more reliable than mechanical connections. In addition, such jet pipe structure can allow passage of up to 150 micron particles in miniature servovalves without malfunction.

The pilot stage also includes the counterweight 98 secured to the driver arm 52 by resilient elastomeric O-rings 100 and 102. The counterweight serves as a vibration damper and is made of tungsten carbide to balance the forces on the suspended drive arm and jet pipe member. The elastomeric mounting of the counterweight dampens the motion of the armature when it is driven at its natural frequency by absorbing some of the energy.

The pilot stage 14 of the electrohydraulic servovalve 10 further includes the receiver passages 104 and 106 in the spool 96 which respectively communicate through the passages 108 and 110 with the opposite ends of the spool 96. The receiver passages 104 and 106 are separated by a thin partition 107 at jet pipe nozzle 78 and are rectangular in cross section whereby the effect of misalignment of the openings perpendicular to the plane of movement of the drive arm 52 and the jet pipe nozzle 78 is minimized.

In operation, the pilot stage 14 produces movement of the spool 96 and amplifies the relatively low force level of the electromagnetic positioner output into the high stiffness required to reliably drive the spool 96. In this regard, the receiver passages 104 and 106 provide the position feedback for the spool. Thus, the right receiver passage 106 is connected to the chamber 112 at the left end of the spool 96, and the left receiver passage 104 is connected to the chamber 114 at the right end of the spool 96, as shown in FIG. 1.

When the jet pipe nozzle 78 moves, for example, to the right in FIG. 1, due to an unbalanced electrical force applied to the coils 36, 38, 40 and 42, the pressure in the right receiver passage 106 will increase, and that in the left receiver passage 104 will decrease, causing a change in the pressures in the chambers 112 and 114 to move the spool 96 to the right. The spool 96 will move rightward under the influence of this force until the receiver passages 104 and 106 are again centered under the jet pipe nozzle 78, and the pressure at each end of the spool is equal.

Thus, the spool will achieve the same motion as the jet pipe nozzle motion, whose motion is proportional to the input current. The hydraulic feedback of the spool motion is without any mechanical contact and provides smooth control without discontinuities and allows precise control of the valve null.

The second stage or main valve portion 16 of the electrohydraulic servovalve 10 includes the valve body member 88, a sleeve 116 which may be shrink-fit into the opening 118 through the valve body member 88 which includes the two internal, annular, axially spaced apart metering grooves 120 and 122 therein.

The spool 96 is positioned within the opening 124 in the sleeve 116. Spool 96 is provided with five separate lands 126, 128, 130, 132 and 134 thereon separating annular grooves 136, 138, 140 and 142. Slot and key construction 144 are provided between the sleeve 116 and spool 96 at one end thereof to prevent relative rotation between the spool 96 and the sleeve 116 about the longitudinal axes thereof.

The end caps 146 and 148 are threaded onto the opposite ends of the sleeve 116 and are sealed with respect thereto by O-rings 150 and 152, respectively.

The basic operation of the second stage 16 of the electrohydraulic servovalve 10 is as a four-way hydraulic valve with four metering edges, only two of which are normally active in each direction of spool motion. The metering edges, that is, the edges on the lands 128 and 132, are individually matched to the grooves 120 and 122 in the sleeve 116 so that any lap arrangement such as underlap, overlap, zero lap, etc., may be accommodated.

Due to the five-land construction of the spool 96, wherein the return pressure is in the grooves 138 and 140, and supply pressure is in the grooves 136 and 142, with the lands 126 and 134 sealing the spool valve at its opposite ends, with the lands 128 and 132 providing metering edges, and the center land 130 which is of slightly smaller diameter accommodating the receiver passages 104 and 106, the varying pressures at the output ports cannot act on the spool and elongate any of the critical dimensions of the laps. The pressures in the grooves are relatively invariant and any dimensional change along the grooves is inconsequential. A more efficient operation is thus obtained than with the traditional three-landed spool in which varying output pressure present in the grooves will elongate the critical dimensions of the valve spool.

As will be understood by those in the art, the hydraulic fluid in the passages 154 and 158 is controlled in accordance with the position of the spool valve 96 and more particularly in accordance with the positioning of the metering edges of the lands 128 and 132.

While one embodiment of the present invention has been considered in detail, it will be understood that other embodiments and modifications thereof are contemplated by the inventors. It is the intention to include all embodiments and modifications as are defined by the appended claims within the scope of the invention.

We claim:

1. A two-stage electrohydraulic miniature servovalve comprising an electromagnetic positioner, a jet pipe pilot stage and a four-way hydraulic valve incorporating position follower type spool control wherein the electrohydraulic servovalve includes a metering spool therein having a longitudinal axis and a drive arm and wherein the pilot stage includes a jet pipe member secured to the end of the drive arm including a jet pipe nozzle extending on the axis of the drive arm and perpendicularly to the metering spool and a jet pipe feeder passage within the drive arm which extends substantially perpendicularly to the jet pipe nozzle and metering spool and which feeder passage is in hydraulic communication with the jet pipe nozzle, a source of hydraulic fluid under pressure and a second nozzle having a larger capacity than the jet pipe nozzle positioned adjacent the jet pipe feeder passage for passing the fluid under pressure into the jet pipe feeder passage.

2. Structure as set forth in claim 1, wherein the pilot stage further includes passages in the spool extending first radially and then axially to the opposite ends of the spool, said radially extending portions of the passages are separated by a thin partition and open adjacent to the jet pipe nozzle whereby fluid from the jet pipe nozzle divided between the radially extending portions of the passages through the spool will create pressure at the opposite ends of the spool in accordance with the division of fluid between the radially extending portions of the passages through the spool to axially adjust the spool.

3. Structure as set forth in claim 1, wherein the second nozzle is positioned perpendicularly to the plane of movement of the drive arm whereby the hydraulic fluid pressure will not react adversely on the drive arm.

4. A two-stage electrohydraulic miniature servovalve comprising an electromagnetic positioner, a jet pipe pilot stage, and a four-way hydraulic valve incorporating position follower type spool control, including an outer body having a bore therethrough, a sleeve secured within the bore, a metering spool positioned within the sleeve, said sleeve and spool having interacting lands and grooves therein for metering fluid through the valve in accordance with the relative axial position of the spool and sleeve including two metering grooves on the internal diameter of the sleeve and five lands separated by four grooves on the spool valve including a central land of smaller diameter than the other lands, two metering lands adapted to coincide with the metering grooves in the sleeve with the spool centrally aligned in the sleeve and two end lands for sealing between the ends of the spool and the internal diameter of the sleeve.

5. Structure as set forth in claim 4 wherein the electrohydraulic servovalve includes a drive arm and wherein the central land has a recess therein receiving the end of the drive arm.

6. A two-stage electrohydraulic miniature servovalve comprising an electromagnetic positioner, a jet pipe pilot stage, and a four way hydraulic valve incorporating position follower type spool control, including an outer body having a bore therethrough, a sleeve secured within the bore, a metering spool positioned within the sleeve, said sleeve and spool having interacting lands and grooves therein for metering fluid through the valve in accordance with the relative axial position of the spool and sleeve, said metering spool including a longitudinal axis, said electromagnetic positioner including a drive arm having an axis, said pilot stage including a jet pipe member secured to the end of the drive arm including a jet pipe nozzle extending on the axis of the drive arm and perpendicularly to the metering spool and a jet pipe feeder passage within the drive arm which extends substantially perpendicularly to the jet pipe nozzle and metering spool and which feeder passage is in hydraulic communication with the jet pipe nozzle, a source of hydraulic fluid under pressure and a second nozzle having a larger capacity than the jet pipe nozzle positioned adjacent the jet pipe feeder passage for passing the fluid under pressure into the jet pipe feeder passage.

7. Structure as set forth in claim 6, wherein the pilot stage further includes passages in the spool extending first radially and then axially to the opposite ends of the spool, said radially extending portions of the passages are separated by a thin partition and open adjacent to the first mentioned jet pipe nozzle whereby fluid from the jet pipe nozzle divided between the radially extending portions of the passages through the spool will create pressure at the opposite ends of the spool in accordance with the division of fluid between the radially extending portions of the passages through the spool to axially adjust the spool.

8. Structure as set forth in claim 6, wherein the second nozzle is positioned perpendicularly to the plane of movement of the drive arm whereby the hydraulic fluid pressure will not react adversely on the drive arm.

9. A two-stage electrohydraulic miniature servovalve comprising an electromagnetic positioner including a mounting plate, a drive arm, flexture tube means resiliently mounting the drive arm on the mounting plate, an armature secured to the drive arm, pole pieces mounted on the mounting plate positioned on each side of the drive arm in close relation to the ends of the armature, electric coils positioned on the pole pieces for producing an electromagnetic force on the armature in proportion to electric current passed through the coils, and permanent magnets secured to the mounting plate positioned between the mounting plate and the armature for producing a permanent magnetic force on the armature whereby control of the movement of the drive arm is effected in accordance with the interaction between the magnetic forces produced by the electric current and the magnets operating on the armature, a jet pipe pilot stage, and a four-way hydraulic valve incorporating position follower type spool control, including an outer body having a bore therethrough, a sleeve secured within the bore, a metering spool positioned within the sleeve, said sleeve and spool having interacting lands and grooves therein for metering fluid through the valve in accordance with the relative axial position of the spool and sleeve.

10. Structure as set forth in claim 9, wherein two separate electric coils are provided on each pole piece and one end of each of the coils on one pole piece is connected to a separate coil on the other pole piece and the connected coils are wound in opposite directions on their respective pole pieces whereby the four coils act as two coils and can be connected in series or in parallel and provide an electric field between the pole pieces and armature in accordance with the polarity and strength of the electric signal applied to the coils.

11. Structure as set forth in claim 10, and further including adjustable stroke limiting means operable between the armature and pole pieces for limiting the movement of the armature and stroke of the drive arm.

12. A two-stage electrohydraulic servovalve comprising an electromagnetic positioner, a jet pipe pilot stage and a four-way hydraulic valve incorporating position follower type spool control wherein the electrohydraulic servovalve includes a metering spool therein having a longitudinal axis and a drive arm and wherein the pilot stage includes a jet pipe nozzle extending on the axis of the drive arm and perpendicularly to the metering spool and a jet type feeder passage within the drive arm which extends perpendicularly to the jet pipe nozzle and metering spool whereby the jet pipe feeder passage, jet pipe nozzle and metering spool are on three mutually perpendicular axes, which feeder passage is in hydraulic communication with the jet pipe nozzle, a source of hydraulic fluid under pressure and means positioned adjacent the jet pipe feeder passage for passing the fluid under pressure into the jet pipe feeder passage comprising a second nozzle having a larger capacity than the jet pipe nozzle.

13. Structure as set forth in claim 12, wherein the drive arm is pivotally movable in the plane defined by the axis of the drive arm and the axis of the spool and wherein the feeder passage and second nozzle are axially aligned and positioned perpendicularly to the plane of movement of the drive arm whereby the hydraulic fluid pressure will not react adversely on the drive arm.

* * * * *